US006868771B2

(12) United States Patent
Neuhaeuser

(10) Patent No.: US 6,868,771 B2
(45) Date of Patent: Mar. 22, 2005

(54) MOUNTING FOR MAGNETIC FIELD SENSORS

(75) Inventor: Torsten Neuhaeuser, Bahlingen (DE)

(73) Assignee: Sick AG, Waldkirch (DE)

( * ) Notice: Subject to any disclaimer, the term of this patent is extended or adjusted under 35 U.S.C. 154(b) by 86 days.

(21) Appl. No.: 10/401,528

(22) Filed: Mar. 26, 2003

(65) Prior Publication Data

US 2004/0031385 A1 Feb. 19, 2004

(30) Foreign Application Priority Data

Mar. 27, 2002 (DE) ..... 202 04 874 U

(51) Int. Cl.[7] ..... F15B 15/20
(52) U.S. Cl. ..... 91/1; 92/5 R
(58) Field of Search ..... 91/1; 92/5 R; 73/866.5

(56) References Cited

U.S. PATENT DOCUMENTS 6,101,920 A 8/2000 Leonhardt
6,590,156 B2 * 7/2003 Franke et al. ..... 174/50
6,637,279 B2 * 10/2003 Kroll et al. ..... 73/866.5

FOREIGN PATENT DOCUMENTS

DE P 44 35 671.4 A1 4/1995
DE 196 43 413.0 A1 5/1998
DE 196 48 679.3 A1 6/1998
DE 196 53 222 A 1 7/1998
DE 196 53 222.1 A1 7/1998
DE 202 18 204 U 1 3/2003
EP 0 923 678 B1 6/1998
EP 923678 B1 * 1/2003 ..... F16B/37/04
JP 2001-2 80 310 A 10/2001
JP 2001280310 10/2001

* cited by examiner

*Primary Examiner*—Thomas E. Lazo
(74) *Attorney, Agent, or Firm*—Townsend and Townsend and Crew LLP

(57) ABSTRACT

An arrangement for axially variably mounting a magnetic field sensor in a guide groove arranged on the exterior of an operating cylinder in which a piston reciprocates. The groove is longitudinally slitted and the sensor has a generally elliptical cross-section which is dimensioned so that the sensor can be inserted into the groove through the slit. By turning the sensor about its longitudinal axis, it becomes restrained to the groove while permitting sliding movement of the sensor over the length of the groove. A screw with an oval head is threaded into the sensor, is disposed inside the groove, and upon turning it the head of the groove engages interior shoulders extending along both sides of the slit. By turning the screw so that the head engages the shoulder, the sensor becomes clamped and thereby fixedly positioned at the desired location along the groove.

14 Claims, 2 Drawing Sheets

MOUNTING FOR MAGNETIC FIELD SENSORS

BACKGROUND OF THE INVENTION

The invention relates to a magnetic field sensor that is axially adjustably arranged on the housing of a cylinder. Such magnetic field sensors (hereinafter frequently simply "sensor") have been successfully employed for precisely determining the location of pistons, such as pneumatic or hydraulic pistons, inside a cylinder in a touchless manner. To achieve this, sensors can be axially moved and then fixed at a given position in guide grooves arranged on the outer surfaces of the cylinder housing.

The guide grooves can have a cylindrical as well as a rectangular cross-section, and longitudinal slits provide access to the grooves from the outside.

Such a mounting of magnetic field sensors on a cylinder is disclosed by German patent publication DE 44 35 675 A1. The sensor disclosed in that publication has an essentially circular cross-section and is placed in a longitudinally slitted cylindrical groove.

Sensors must be inserted into such a C-groove from the free end of the groove. Once in the groove, the sensor can be axially moved into the desired position. Removal of the sensor from the C-groove is only possible by pushing the sensor out of the free end of the groove. This approach to inserting or removing the sensor from the housing of a cylinder is particularly disadvantageous when several sensors are simultaneously arranged in the groove because in such an event the sensors must be serially pushed into or out of the groove. In view thereof, German patent publications DE 196 43 413 and DE 196 53-222 disclose magnetic field sensors which have a cross-section so that they can be inserted into the partially open guide groove at any desired location along the length thereof. The sensors have a cross-section with a first, narrow side that can be inserted into the groove. Thereafter the sensor is rotated about its longitudinal axis to retain it in the groove. A set screw fixes the sensor in place and, when tightened, the screw engages and is supported by the base of the groove while it presses the sensor against a shoulder formed at the opposite side of the groove cross-section. A disadvantage of the known sensor positioning arrangements is that they necessarily form an air gap between the sensor and the cylinder housing which is caused by the mechanical tolerances of the guide groove and the cross-section of the sensor. The deviations in the air gap influence the magnetic fields, which in turn can adversely affect the functioning and accuracy of the sensor. A further disadvantage is that by fixing the sensor with a set screw the sensor becomes mechanically stressed, which can lead to a bending of or even damage to the sensor.

BRIEF SUMMARY OF THE INVENTION

It is an object of the invention to provide a magnetic field sensor which can be inserted and fixed at any desired location along a wide variety of guide grooves which, due to production requirements and/or source, may be differently formed. When the sensor is positionally fixed, the present invention assures that the air gap between the sensor and the cylinder remains constant, and further that mechanical stresses in the sensor are minimized. In addition, the axial repositioning of the sensor in the groove should be easy, precise and reproducible.

This objective is attained by arranging a guide groove on the exterior of the cylinder which has a slit that extends parallel to the groove and communicates the groove with the exterior. The groove has a base opposite the slit and interior shoulders that extend along the slit and face the base. The sensor has a cross-section so that the sensor can be inserted into the groove through the slit and, upon rotating the sensor about its longitudinal axis, the sensor is retained in the groove. A screw is threaded into the sensor, is disposed inside the groove, and is operative so that upon turning the screw a portion of the head engages the groove shoulders and thereby forces the sensor against the base of the groove to fix it at a desired position in the groove.

In accordance with the invention, the magnetic field sensor has an approximately elliptical cylindrical shape so that in one orientation of the sensor it is freely insertable into the guide groove through a slit therein and so that it can thereafter be rotated about its longitudinal axis to retain it in the groove. The sensor is positionally fixed with a set screw having an oval-shaped head. To fix the position of the sensor, the screw is turned so that its oval-shaped head moves towards shoulders which run along the longitudinal slit of the groove while the screw presses the sensor against the base of the groove. As a result, the spacing between the magnetic field sensors and the piston in the cylinder remains constant.

It is preferable to use a special oval-head screw. The head has an outer diameter and curvature that is fitted to the longitudinal gap of the guide groove. This advantageously centers the sensor relative to the longitudinal groove gap when the set screw is tightened.

A further aspect of the invention places an interiorly threaded sleeve in the sensor which slightly projects beyond the side of the sensor facing the base of the groove. In this embodiment of the invention, a tightening of the set screw does not mechanically stress the sensor because only the screw and sleeve are stressed between the base of the groove and the groove shoulders that adjoin the open groove slit.

In a further preferred embodiment of the invention the set screw of the sensor is positioned proximate the end surface of the sensor through which a connecting cable enters the sensor. This isolates forces that may act on the cable and prevents them from negatively affecting the sensor electronics. This has the further advantage that the sensing element of the sensor can be placed very close to the other end, or tip, of the sensor, which in turn permits the sensor to even detect terminal positions of the piston that lie beyond the end of the guide groove.

For magnetic field sensors which have a plastic housing, it is particularly advantageous to use metallic sleeves. Since the tightening of a screw connection usually involves turning the screw in a clockwise direction, it is advantageous to provide a left-handed thread between the screw and the sleeve, because in such an event the sensor can be fixed at a desired position by turning the oval-shaped screw in the customary, clockwise direction.

DETAILED DESCRIPTION OF THE INVENTION

Figure 1:
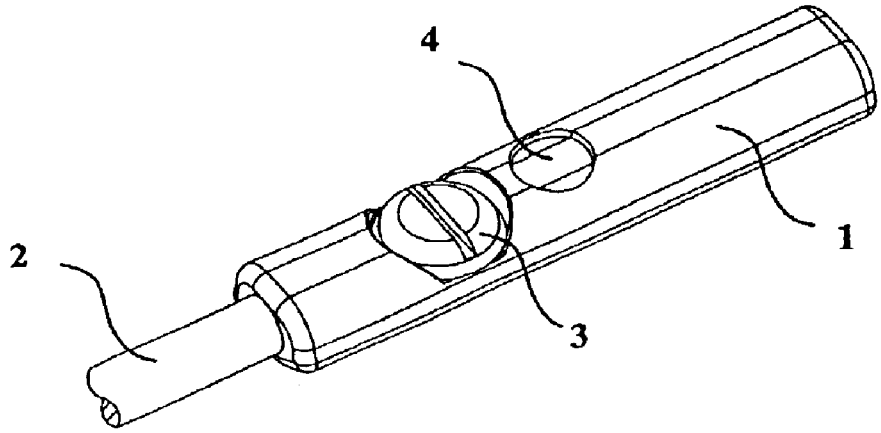
FIG. 1 is a perspective view of a magnetic field sensor constructed in accordance with the invention.

Referring to FIG. 1, a magnetic field sensor 1 has an electrical connecting cable 2. A generally convex oval-head screw 3 is recessed into the sensor so that, in the illustrated, fully retracted position, the screw head does not extend past the approximately elliptical cross-section of the sensor. A window 4, which provides access to functional displays, is arranged proximate screw 3.

Figure 2A:
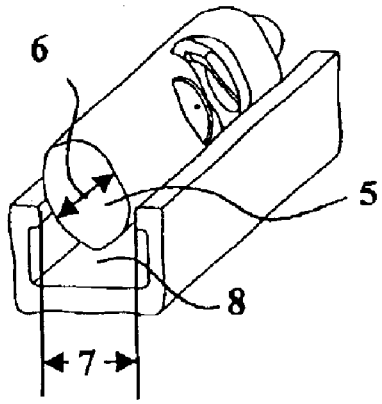
FIG. 2*a* is a perspective view which schematically illustrates the insertion of the sensor in a guide groove.

Referring to FIG. 2*a*, the approximately elliptical cross-section 5 of the sensor has a minor axis 6 the length of which is sufficiently less than the width of slit 7 which extends along guide groove 8 so that the magnetic field sensor can be inserted at any point along the groove.

Figure 2B:
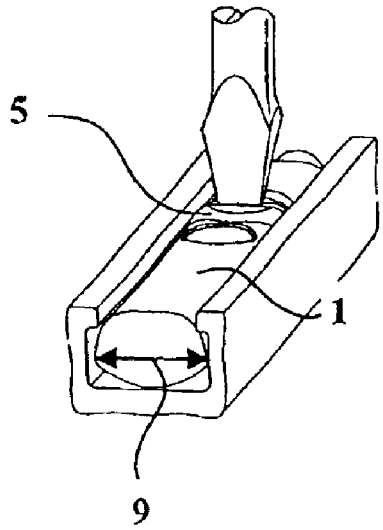
FIG. 2*b* is a perspective view which schematically illustrates the retention of the sensor in the groove.

Referring to FIG. 2*b*, by axially rotating the sensor approximately 90°, the major axis 9 of the approximately elliptical sensor cross-section becomes parallel to groove slit 7, as is illustrated in the drawing. In this position, the sensor cannot be removed from the guide groove because the major elliptical axis of the cross-section exceeds the width of groove slit 7. To immovably fix sensor 1 in the guide groove, oval-head screw 3 is turned so that it moves in a direction toward groove slit 7.

Figure 3:
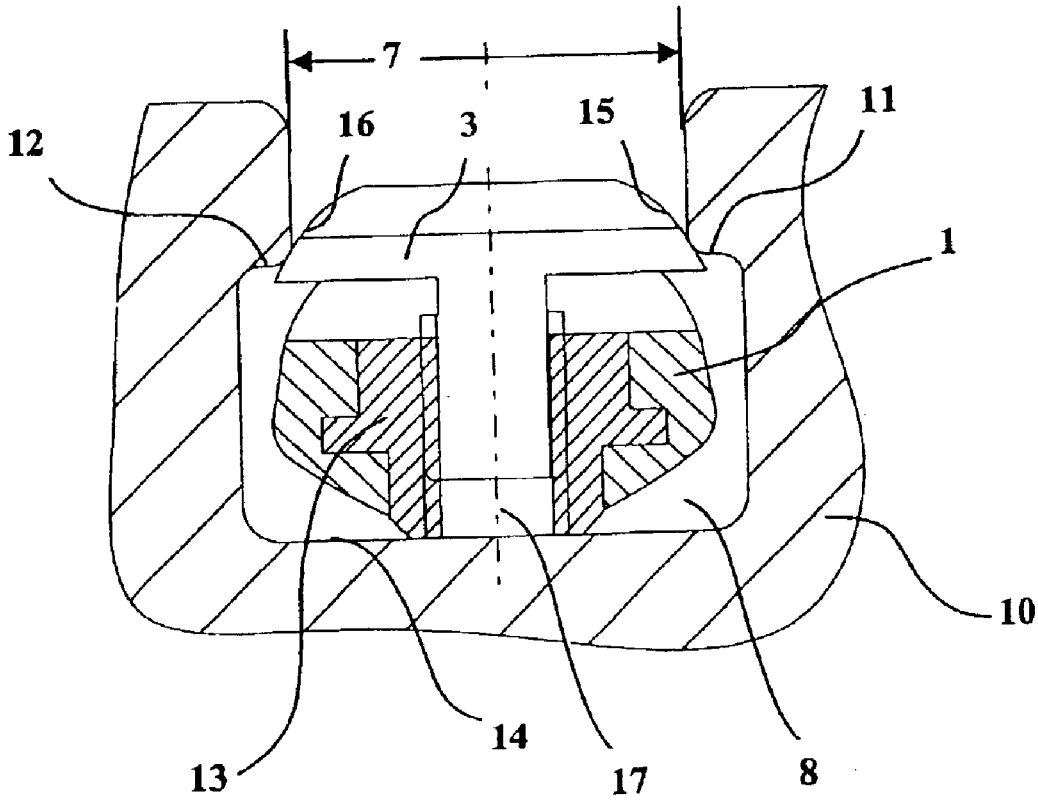
FIG. 3 is an enlarged cross-sectional view of the guide groove and the sensor in a plane which intersects the axis of the oval-shaped fixing screw.

Referring to FIG. 3, which is a cross-sectional view of the sensor taken along the longitudinal axis of oval-head screw 3, a housing 10 of a cylinder is shown. The housing includes a rectangular guide groove 8 with a longitudinal slit 7 that extends over the length of the groove and provides access to the groove from the exterior. Respective groove shoulders 11 and 12 are formed along each side of groove slit 7. The field sensor 1 includes an interiorly threaded sleeve 13 into which oval-head screw 3 is threaded. In one preferred embodiment of the invention, the sensor has a plastic housing and the sleeve is made of metal and is anchored in the housing. Since the maximum diameter of the underside of the screw head is larger than the width of slit 7 of the groove, the downwardly sloping, generally conically shaped flanks 15, 16 engage the groove shoulders 11, 12 when the oval-head screw 3 is turned so that it moves out of the sleeve. This causes the screw head flanks 15, 16 to press the field sensor 1 and its sleeve, which slightly projects beyond the sensor, against base 14 of the groove to thereby clamp the sensor to the groove at the desired position. At the same time, the sloping flanks of the special oval-shaped screw 3 center the sensor relative to an axis of symmetry 17 of the groove.

What is claimed is:

1. Apparatus for axially variably mounting a magnetic field sensor on an exterior of a cylinder having a piston on its interior comprising a guide groove on the exterior of the cylinder and a slit which extends parallel to the groove and communicates the groove with the exterior, the groove having a base opposite the slit and first and second shoulders extending along the respective sides of the slit and facing the base, a sensor including a plastic housing and having a cross-section so that the sensor can be inserted into the groove through the slit and, upon rotating the sensor about its longitudinal axis, the sensor is retained in the groove, a metal sleeve in the plastic housing with an interior thread and a screw having a head, being threaded into the metal sleeve and being disposed inside the groove, the screw being operative so that upon turning the screw a portion of the head engages the first and second shoulders and thereby clamps the sensor against the base of the groove to fix the sensor at a desired position in the groove.

2. Apparatus according to claim 1 wherein the cooperating threads on the screw and in the sensor are left-handed threads.

3. Apparatus according to claim 1 wherein the sensor has an end surface, and including a connecting cable attached to the sensor and extending through the end surface, and wherein the screw is arranged on the sensor proximate the end surface.

4. Apparatus according to claim 1 wherein the sensor has first and second end surfaces, and further including a connecting cable attached to the sensor and extending through the first end surface, and a sensor element for detecting the position of the piston in the cylinder arranged proximate the second end of the sensor for detecting the position of the piston in the cylinder.

5. Apparatus for axially variably mounting a magnetic field sensor on an exterior of a cylinder having a piston on its interior comprising a guide groove on the exterior of the cylinder and a slit which extends parallel to the groove and communicates the groove with the exterior, the groove having a base opposite the slit and at least one interior shoulder extending along the slit and facing the base, a sensor including a plastic housing with a threaded metallic sleeve, the sensor having a cross-section so that the sensor can be inserted into the groove through the slit and, upon rotating the sensor about its longitudinal axis, the sensor is retained in the groove, and a screw having a head, being threaded into the metallic sleeve and being disposed inside the groove, the screw being operative so that upon turning the screw a portion of the head engages the at least one shoulder and thereby clamps the sensor against the base of the groove to fix the sensor at a desired position in the groove.

6. Apparatus for axially variably mounting a magnetic field sensor on an exterior of a cylinder having a piston on its interior comprising a guide groove on the exterior of the cylinder and a slit which extends parallel to the groove and communicates the groove with the exterior, the groove having a base opposite the slit and at least one interior shoulder extending along the slit and facing the base, a sensor having a cross-section so that the sensor can be inserted into the groove through the slit and, upon rotating the sensor about its longitudinal axis, the sensor is retained in the groove, the sensor having an end surface and a cable extending from the end surface, and a screw arranged on the sensor proximate the end surface having a head, being threaded into the sensor and being disposed inside the groove, the screw being operative so that upon turning the screw a portion of the head engages the at least one groove shoulder and thereby clamps the sensor against the base of the groove to fix the sensor at a desired position in the groove.

7. Apparatus according to claim 6 including first and second shoulders arranged adjacent respective sides of the slit.

8. Apparatus according to claim 7 including a sleeve in the magnetic field sensor with an interior thread engaging the screw so that, upon turning the screw, the sleeve presses the sensor towards the base of the groove.

9. Apparatus according to claim 8 wherein the sleeve comprises a metal sleeve.

10. Apparatus according to claim 9 wherein the magnetic field sensor comprises a housing made of plastic and the metal sleeve is connected to the plastic housing.

11. Apparatus according to claim 8 wherein the sleeve projects past a side of the sensor facing the base of the groove so that, upon turning the screw such that the screw head engages the shoulders, the sleeve engages the base of the groove.

12. Apparatus according to claim 7 wherein the screw head is an oval-shaped screw head having a conically shaped surface portion which, when the screw head engages the shoulders of the groove, centers the screw relative to the slit of the groove.

13. Apparatus for axially variably mounting a magnetic field sensor on an exterior of a cylinder having a piston on its interior comprising a guide groove on the exterior of the cylinder and a slit which extends parallel to the groove and communicates the groove with the exterior, the groove having a base opposite the slit and at least one interior shoulder extending along the slit and facing the base, a sensor having a cross-section so that the sensor can be inserted into the groove through the slit and, upon rotating the sensor about its longitudinal axis, the sensor is retained in the groove, and a screw having a head, being threaded into the sensor and being disposed inside the groove, the sensor having first and second end surfaces, a connecting cable attached to the sensor and extending through the first end surface, and a sensor element arranged between the first and second end surfaces and proximate to the second end surface of the sensor for detecting the position of the piston in the cylinder, the screw being operative so that upon turning the screw a portion of the head engages the at least one groove shoulder and thereby clamps the sensor against the base of the groove to fix the sensor at a desired position in the groove.

14. Apparatus according to claim 13 wherein the screw is arranged on the sensor proximate the first end surface.

* * * * *